US006552305B2

(12) United States Patent
De'Longhi

(10) Patent No.: US 6,552,305 B2
(45) Date of Patent: Apr. 22, 2003

(54) MULTI-FUNCTIONAL OVEN FOR COOKING FOOD

(75) Inventor: Giuseppe De'Longhi, Treviso (IT)

(73) Assignee: De'Longhi S.p.A., Treviso (IT)

( * ) Notice: Subject to any disclaimer, the term of this patent is extended or adjusted under 35 U.S.C. 154(b) by 0 days.

(21) Appl. No.: 09/992,487

(22) Filed: Nov. 14, 2001

(65) Prior Publication Data

US 2002/0074323 A1 Jun. 20, 2002

(30) Foreign Application Priority Data

Nov. 22, 2000 (IT) ..... MI2000A2510

(51) Int. Cl.[7] ..... A21B 1/26
(52) U.S. Cl. ..... 219/400; 126/21 A
(58) Field of Search ..... 219/400; 126/21 A; 99/474–476

(56) References Cited

U.S. PATENT DOCUMENTS

| | | | | | |
|---|---|---|---|---|---|
| 3,148,674 | A | * | 9/1964 | Boardman et al. | 126/21 A |
| 4,585,923 | A | * | 4/1986 | Binder | 219/400 |
| 4,829,158 | A | * | 5/1989 | Burnham | 219/400 |
| 5,309,981 | A | * | 5/1994 | Binder | 126/21 A |
| 5,697,360 | A | * | 12/1997 | Cigarini et al. | 219/400 |
| 6,069,344 | A | * | 5/2000 | Krasznai et al. | 219/400 |

* cited by examiner

*Primary Examiner*—Joseph Pelham
(74) *Attorney, Agent, or Firm*—Herbert Dubno

(57) ABSTRACT

A multifunctional oven provides a fan at a side wall of the baking chanter which draws air into a circulation chamber from the baking chamber and circulates in part back to the baking chamber and in part to a heating chamber below a lower plate forming the bottom of the baking chamber and having a deflector and heater defining a path for air around the deflector. Air is admitted into the baking chamber from the heating chamber.

12 Claims, 5 Drawing Sheets

MULTI-FUNCTIONAL OVEN FOR COOKING FOOD

FIELD OF THE INVENTION

The present invention refers to a multi-functional oven for cooking food, more particularly, to an oven which is electrically powered.

BACKGROUND OF THE INVENTION

Electric ovens of different types currently exist:

static ovens which comprise a case in which heating resistors suitable for cooking food are housed;

fan-assisted ovens which have characteristics similar to those of static ovens and in addition comprise a fan suitable for keeping the air circulating inside the oven itself; and multi-functional ovens which have an analogous structure to that of fan-assisted ovens and are also equipped with an additional resistor at the air intake, suitable for heating the air which is circulated in the oven.

Multi-functional ovens comprise a very large number of components and of the additional resistor makes such ovens very expensive.

Moreover, since during operation both the cooking resistors and the additional resistor have to be supplied with electricity, the wattage of traditional multifunctional ovens is very high.

OBJECTS OF THE INVENTION

An object of the present invention is, therefore, to eliminate the stated technical drawbacks of the prior art, and to provide a multi-functional oven for cooking food which has a limited number of components and, without the additional resistor, can still improve the cooking characteristics of traditional multi-functional ovens and in particular the uniformity of the heating of the food.

Another object is to provide a multi-functional oven which has a restricted wattage with respect to traditional multifunctional ovens.

Yet another object of the invention is to provide a multifunctional oven which has a very flexible operation and, in particular, which can also operate as a static oven or as a fan-assisted oven.

SUMMARY OF THE INVENTION

These and other objects, according to the present invention are achieved in a multi-purpose oven for cooking food comprising a case wherein are housed: a lower plate which separates a baking chamber from a heating chamber wherein is housed resistor heating means, and at least one side plate equipped with first through-openings which separates the baking chanter from a circulation chamber. The oven has a fan suitable for maintaining the air circulation inside of it, making the air pass through the throughopenings. According to the invention, the oven comprises first means for conveying the air from the circulation chamber to the heating chamber and a second means for conveying the air from the heating chamber to the baking chamber.

BRIEF DESCRIPTION OF THE DRAWING

Further characteristics and advantages of the invention will become clearer from the description of a preferred but not exclusive embodiment of the multifunctional oven for cooking food according to the invention, illustrated in the accompanying drawing, wherein.

SPECIFIC DESCRIPTION

A multi-functional oven for cooking food is shown, as a whole, indicated with the reference number 1.

The oven 1 comprises a case 2 wherein is housed a lower plate 3 consisting of a waste collection element which can be removed front the case 2.

Figure 1:
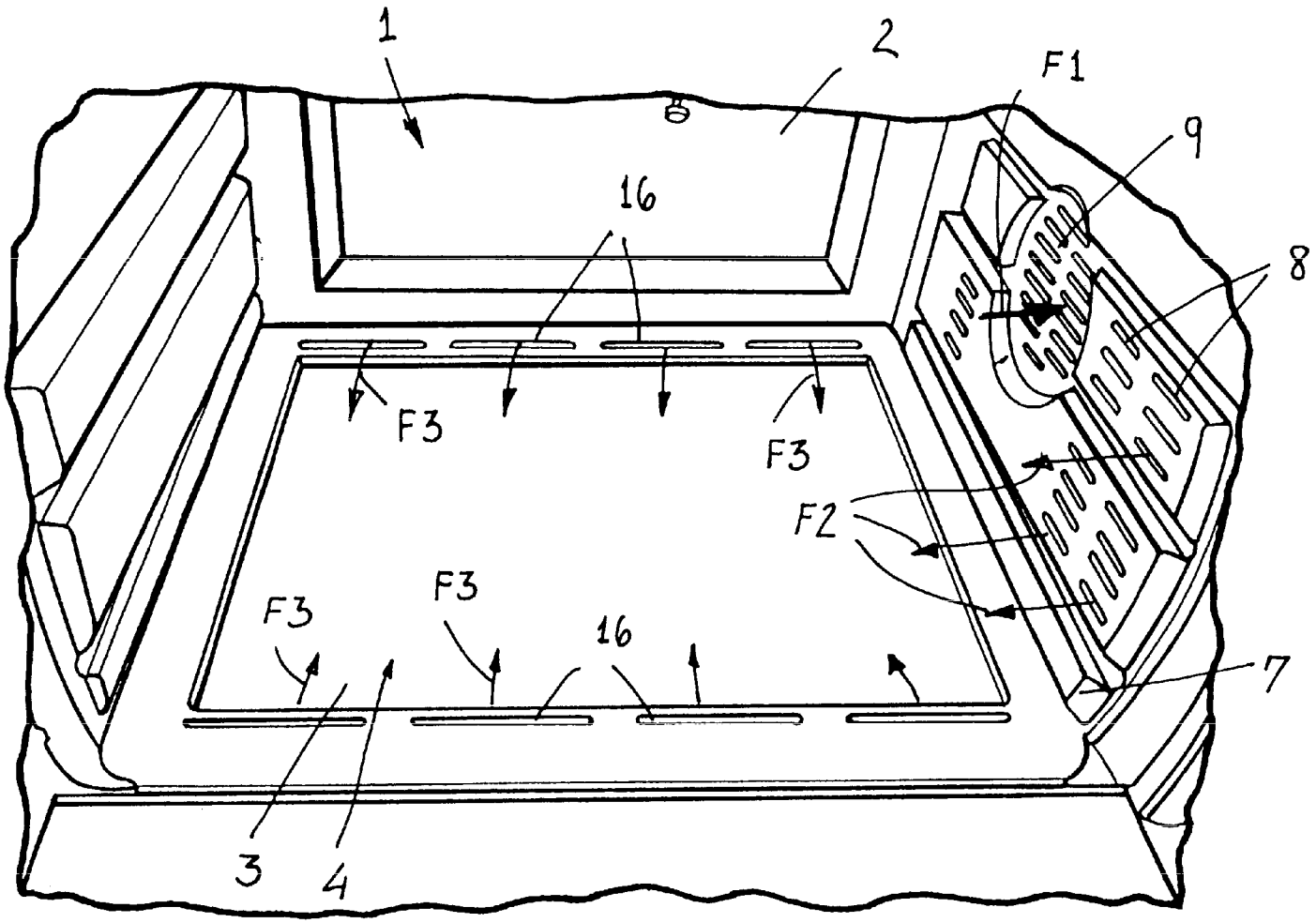
FIG. 1 is a perspective view of a baking chamber of the oven according to the invention.
Figure 2:
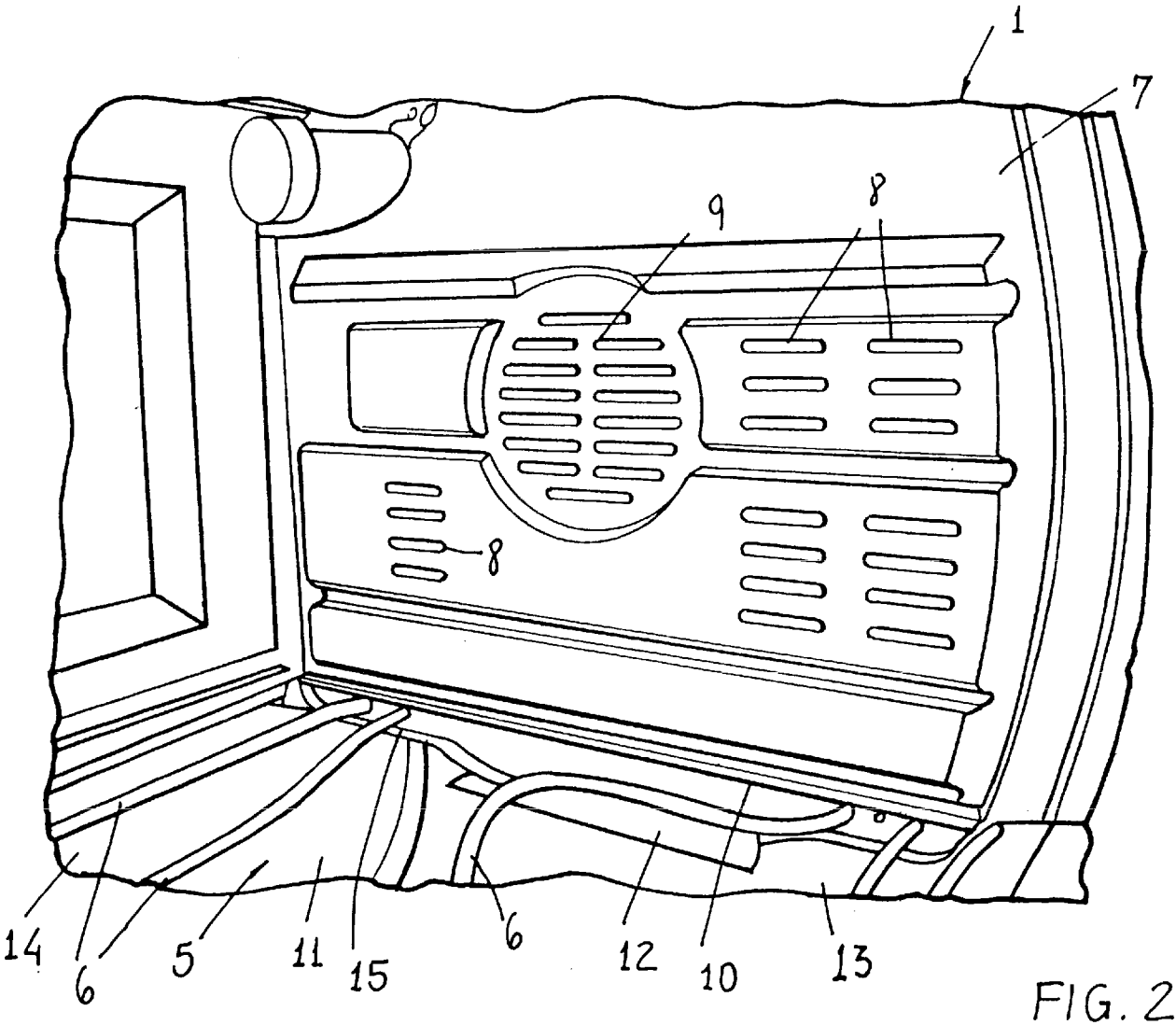
FIG. 2 is a detail of a plate which forms the side border of the baking chamber.
Figure 3:
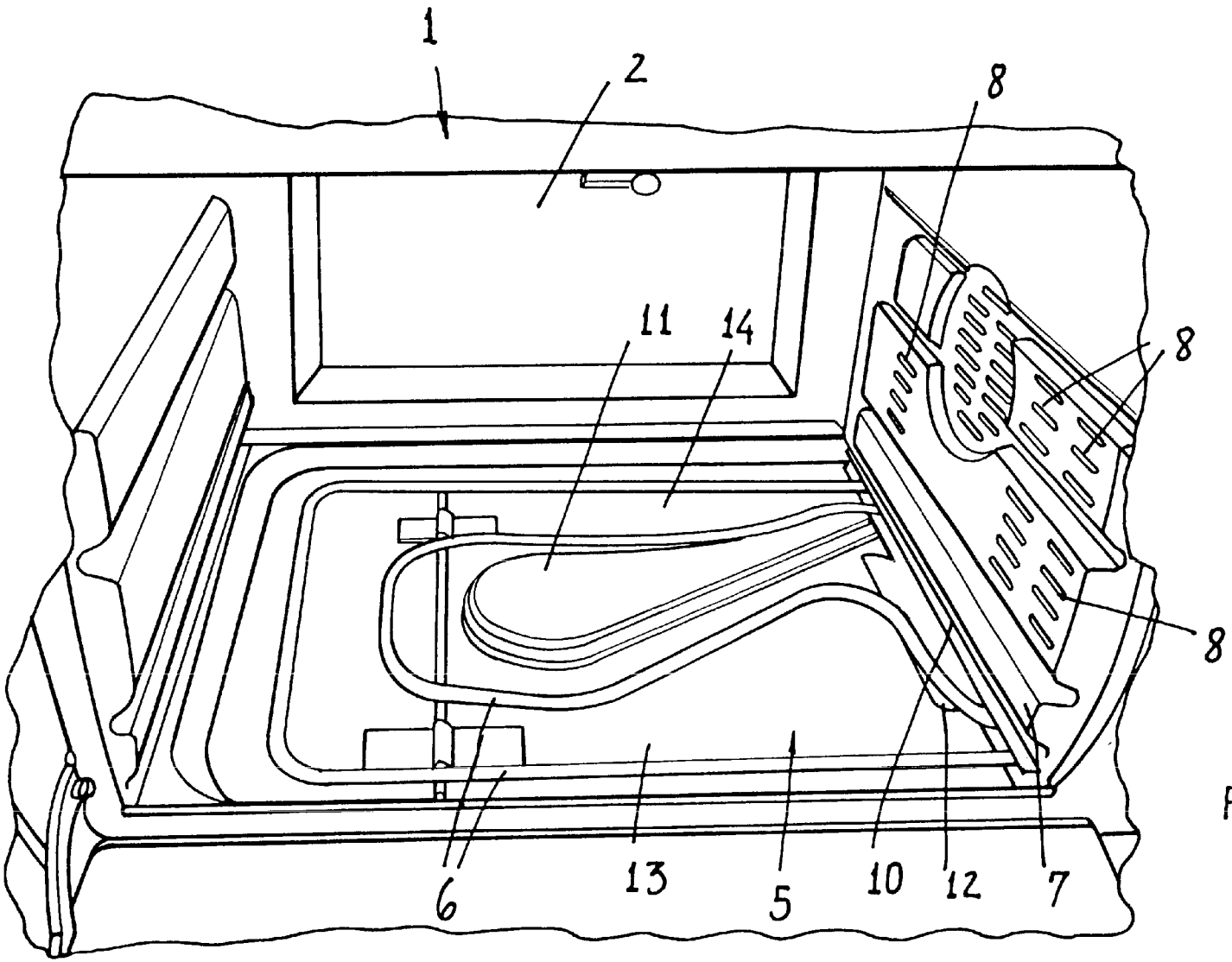
FIG. 3 is a perspective view of an inner portion of the oven according to the invention, without a lower plate which separates a heating chamber from the baking chamber.
Figure 4:
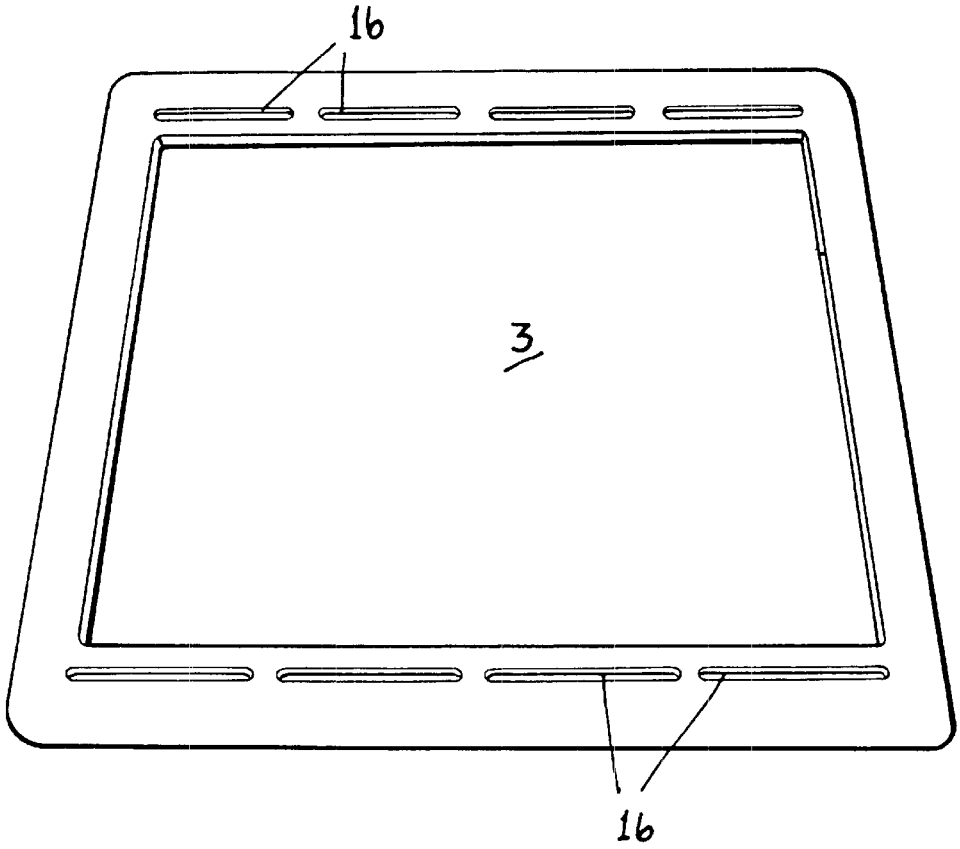
FIG. 4 is a perspective view of the lower plate according to the invention.
Figure 5:
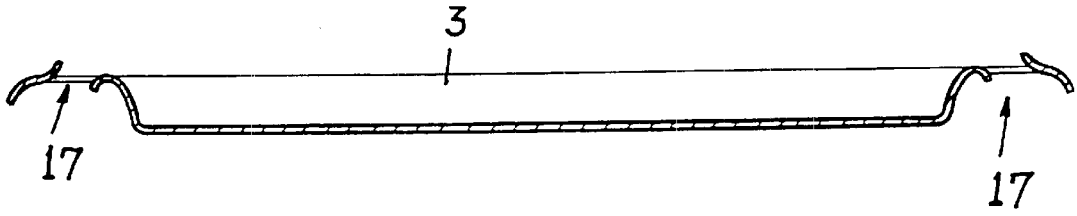
FIG. 5 is a cross-section of the plate according to the invention.
Figure 6:
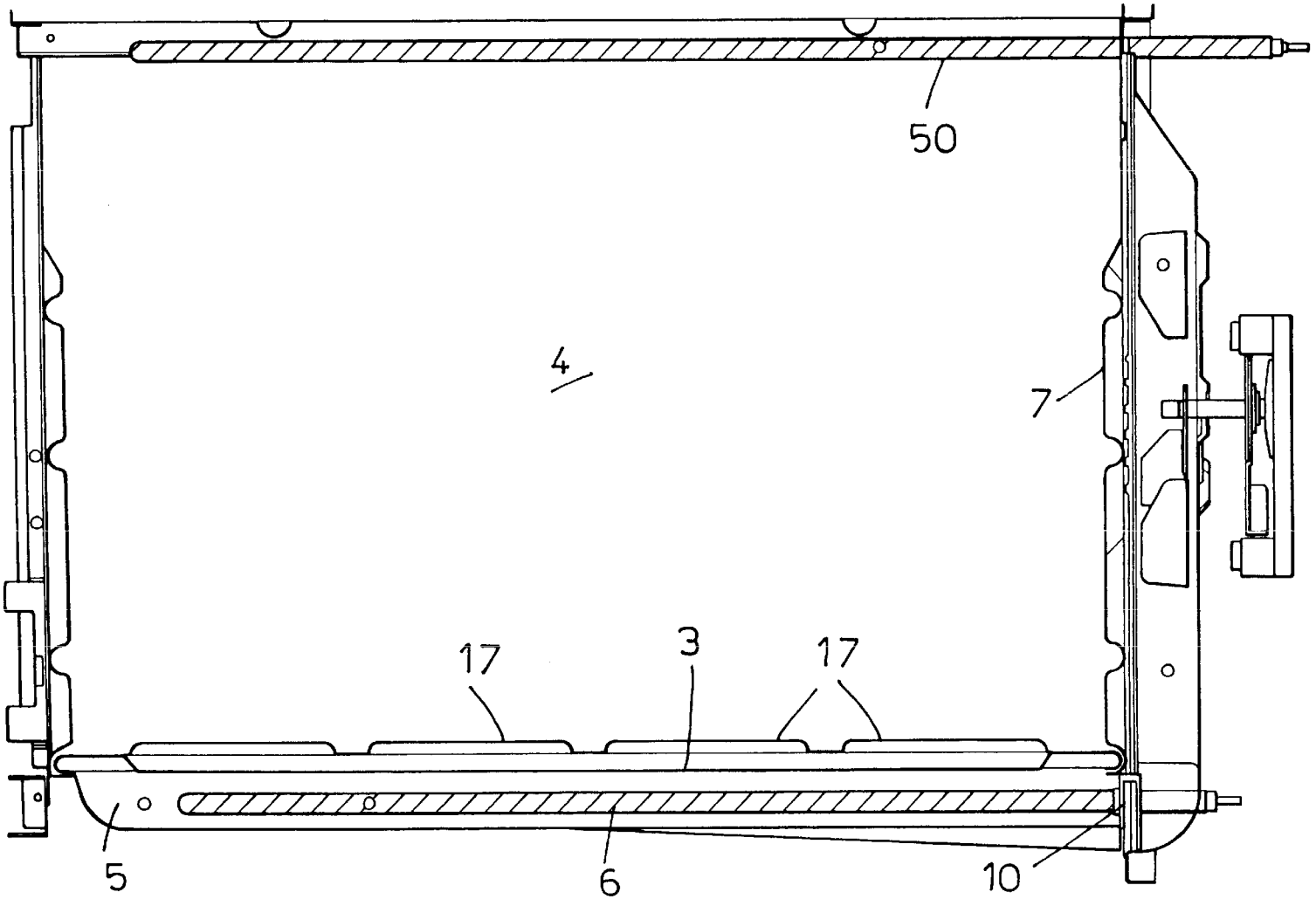
FIG. 6 is a section of the oven according to the invention.

The lower plate 3 separates a baking chanter 4 from a heating chamber S in which is housed resistor heating means 6, consisting of an electrical resistance. Moreover, the oven 1 comprises a further electrical resistance 50 (FIG. 6) at an upper wall of the case 2.

Inside the case 2 is also housed a side plate 7, equipped with first throughopenings 8 and 9, which separates the baking chamber 4 from a circulation chamber (arranged between the plate 7 and the side wall of the case 2).

In the circulation chamber is housed a fan (at the central through-openings 9) which is suitable for putting and keeping the air inside the oven 1 in circulation. The oven 1 comprises, interposed between the circulation chamber and the baking chamber 4, first conveyance means through which the air passes to go front the circulation chamber to the baking chamber 4.

Such first conveyance means comprises a passage 10 interposed between the circulation chanter and the heating chamber 5.

The heating chamber 5 has at least one deflector 11 which defines a preferential path for the air which circulates in the heating chamber 5, with the passage 10 arranged at one inlet end of such a preferential path.

Moreover, at the same passage 10, the oven 1 has intercepting means suitable for preventing the passage of air through the passage 10.

Such intercepting means comprises an element, for example, a foil 12 hinged to the plate 3 at the passage 10, so as to take up one position wherein the passage 10 is closed and another position wherein the passage 10 is open.

Advantageously, the preferential path has an inlet branch 13 with passage sections which are substantially bigger than those of the outlet branch 14, to guide the air and promote its heating and passage in the baking chamber 4. Moreover, the passage 10 is arranged at the inlet branch 13, while the outlet branch 14 ends with a blind wall 15.

The deflector 11 comprises, in the example shown, a single-piece shaped and raised portion integral with a base of the case 2.

Such a solution allows the air to be guided and, at the same time, eases the cleaning and maintenance operations of the heating chamber 5.

Moreover, the lower plate 3 is rested upon the deflector 11.

In different examples of embodiments, however, the deflector 11 takes up a different conformation and consists, for example, of a slanting foil.

The electrical resistance 6 has an extension in the inlet branch 13 which is greater than that in the outlet branch 14.

Indeed, in this way, the air undergoes an intense heating when it enters the heating chamber 5; due to the shortened extension of the resistor 6 (and thus the shorter time in contact with it) the temperature of the air which flows in the baking chamber 4 through second conveyance means 16 is kept: substantially constant.

Moreover, the greater length of the electrical resistance 6 increases the irradiation in the baking chamber 4 through the lower plate 3.

In a preferred embodiment, the inlet branch 13 of the preferential path is arranged at an inlet opening to the oven and, moreover, the electrical resistance 6 has at least one portion which runs along the opening 10.

The lower plate 3 has a plurality of second through-openings 16, as second conveyance means, which allow the passage of the air from the heating chamber 5 to the baking chamber 4.

In different examples the openings 16 can also comprise edge recesses, etc.

Such openings 16 are realized at a front edge and a rear edge of the lower plate 3 (with reference to the plate 3 housed in the oven 1)

Moreover, the openings 16 have deflectors 17 for the conveyance of the air towards the center of the baking chamber 4.

The deflectors 17 comprise an edge protruding towards the base of the plate 3, and another edge protruding in the opposite direction.

Moreover, the lower plate 3 can be capable of sliding, preferably along a side wall of the case 2 and along the side plate 7 to ease its removal and cleaning. The operation of the multi-functional oven for cooking food according to the finding is clear from that which has been described and illustrated and, in particular, is substantially the following.

The oven 1 can operate as a multi-functional oven, as a fan-assisted oven and as a static oven and is, therefore, very flexible.

In the operation as a multi-functional oven, the fan is activated and the passage 10 is left free and not closed by the foil 12.

In this way the lower resistor 6 and the upper resistor 50 heat the oven and, at the same time the fan sucks air through the central openings 9 (as indicated by the arrow F1) and expels it again into the baking chamber 4 through the openings 8 (as indicated by the arrows F2)

Moreover, a part of the air sucked in by the fan goes through the passage 10 and is introduced inside the heating chamber 5.

When it enters the heating chamber 5 the air undergoes an intense heating through the operation of the electrical resistances 6.

Therefore, the air follows the preferential path and goes through the second through-openings 16 of the lower plate 3 passing from the heating chamber 5 to the baking chamber 4 (as indicated by the arrows F3).

When the air goes along the preferential path after the initial intense heating, its temperature is kept substantially constant and, thus, the heating of the food contained in the baking chamber 4 is very uniform guaranteeing an excellent cooking.

In the operation as a fan-assisted oven the foil 12 closes the passage 10 completely.

In this case the oven is heated by the lower and upper resistor, 6 and 50 respectively, and inside of it the fan keeps the air in circulation, passing from the baking chamber 4 to the circulation chamber through the openings 9 (as indicated by the arrow F1) and from the circulation chamber to the baking chamber 4 through the openings 8 (as indicated by the arrows F2)

Finally, not activating the fan, the oven can be used as a static oven.

In this case the baking chamber 4 is heated exclusively by the lower resistor 6 and by the upper resistor 50.

In practice it has been noted how the multi-functional oven for cooking food according to the invention is particularly advantageous because it requires lower production costs and has a lower wattage with respect to traditional ovens, at the same time improving the distribution of the heat and the uniformity of the heating of the food.

Moreover, the multi-functional oven according to the invention has a very flexible operation, also being able to operate as a static or fan-assisted oven.

The multi-functional oven for cooking food thus conceived can have numerous modifications and variants, all of which fall within the inventive concept; moreover, all of the details can be replaced by technically equivalent elements.

In its realization, the materials used, as well as the sizes, can suit the requirements and the state of the art.

What is claimed is:

1. A multi-functional oven comprising:

a case having top, bottom and side walls;

a lower plate in said case defining a heating chamber in said case below said lower plate and a baking chamber in said case above said lower plate;

a resistor heater in said heating chamber;

at least one side plate disposed in said case along a respective side wall and separating said baking chamber from a circulation chamber disposed outwardly of said side plate, said side plate being formed with openings communicating between said baking chamber and said circulation chamber;

a fan in said circulation chamber for circulating air between said baking chamber and said circulation chamber through said openings;

a first passage formed between said circulation chamber and said heating chamber whereby air from said circulation chamber flows into said heating chamber;

a deflector in said heating chamber defining a preferential path for air flowing through said heating chamber, said first passage being located at an inlet end of said preferential path; and at least one second passage formed between said heating chamber and said baking chamber.

2. The oven defined in claim 1 wherein said first passage is provided with an element for preventing flow of air through said first passage in one position and permitting flow of air through said first passage in a second position.

3. The oven defined in claim 2 wherein said lower plate is rested upon said deflector.

4. The oven defined in claim 2 wherein said preferential path has an inlet branch extending from said inlet end of said preferential path with substantially larger passage sections than the passage sections of an outlet branch downstream from said inlet branch.

5. The oven defined in claim 4 wherein said deflector is a raised portion on said bottom of said case.

6. The oven defined in claim 4 wherein said resistor heater has a greater length in said inlet branch than in said outlet branch.

7. The oven defined in claim 6 wherein said inlet branch is located at an inlet opening to said baking chamber.

8. The oven defined in claim 6 wherein said resistor heater comprises an electrical resistance running along said passage.

9. The oven defined in claim 6 wherein said second passage includes a plurality of openings along opposite edges of said lower plate.

10. The oven defined in claim 9 wherein said openings along opposite edges of said lower plate are formed at a front and a rear edge of said lower plate.

11. The oven defined in claim 10 wherein the openings at opposite edges of said lower plate are formed are formed as deflectors for the air.

12. The oven defined in claim 4 wherein said lower plate is removable from the oven.

* * * * *